US010770791B2

(12) United States Patent
Navsariwala et al.

(10) Patent No.: US 10,770,791 B2
(45) Date of Patent: Sep. 8, 2020

(54) SYSTEMS AND METHODS FOR REDUCING SIGNAL RADIATION IN AN UNWANTED DIRECTION

(71) Applicant: PC-TEL, Inc., Bloomingdale, IL (US)

(72) Inventors: Umesh Navsariwala, Bartlett, IL (US); Jesse Lin, Lisle, IL (US)

(73) Assignee: PC-TEL, INC., Bloomingdale, IL (US)

( * ) Notice: Subject to any disclaimer, the term of this patent is extended or adjusted under 35 U.S.C. 154(b) by 234 days.

(21) Appl. No.: 15/910,618

(22) Filed: Mar. 2, 2018

(65) Prior Publication Data

US 2019/0273316 A1 Sep. 5, 2019

(51) Int. Cl.

| | |
|---|---|
| ***H01Q 3/36*** | (2006.01) |
| ***H01Q 3/28*** | (2006.01) |
| ***H01Q 3/30*** | (2006.01) |
| ***H01Q 1/52*** | (2006.01) |
| ***H01Q 3/26*** | (2006.01) |
| ***H01Q 21/29*** | (2006.01) |
| *H01Q 1/22* | (2006.01) |

(52) U.S. Cl.

CPC ..... *H01Q 3/36* (2013.01); *H01Q 1/523* (2013.01); *H01Q 3/2611* (2013.01); *H01Q 3/28* (2013.01); *H01Q 3/30* (2013.01); *H01Q 21/29* (2013.01); *H01Q 1/2291* (2013.01)

(58) Field of Classification Search

CPC combination set(s) only.

See application file for complete search history.

(56) References Cited

U.S. PATENT DOCUMENTS 7,026,989 B1 4/2006 Minkoff et al.
7,808,443 B2 10/2010 Lindmark et al.

(Continued)

FOREIGN PATENT DOCUMENTS

CN 102498615 A 6/2012
EP 1 145 376 10/2001

(Continued)

OTHER PUBLICATIONS

Extended European search report for EP patent application 19160327.3, dated Jul. 30, 2019.

(Continued)

*Primary Examiner* — Mamadou L Diallo

(74) *Attorney, Agent, or Firm* — Husch Blackwell LLP

(57) ABSTRACT

An antenna system that can reduce signal radiation in an unwanted direction while preserving signal radiation outside of the unwanted direction is provided. The antenna system can include a signal input source with a main antenna and a secondary antenna each electrically coupled to the signal input source. The main antenna can transmit a primary signal to produce a primary radiation pattern in response to a first portion of energy from the signal input source, and the secondary antenna can transmit a secondary signal to produce a secondary radiation pattern in response to a second portion of energy from the signal input source. The secondary signal can be amplitude modified and phase shifted to position the secondary radiation pattern to cancel out or reduce a portion of the primary radiation pattern extending in an unwanted direction while substantially preserving portions of the primary radiation pattern outside of the unwanted direction.

20 Claims, 4 Drawing Sheets

(56) References Cited

U.S. PATENT DOCUMENTS

| | | | | |
|---|---|---|---|---|
| 2008/0258993 | A1* | 10/2008 | Gummalla | H01Q 1/243 343/876 |
| 2010/0311353 | A1* | 12/2010 | Teillet | H01Q 1/246 455/84 |
| 2015/0171517 | A1* | 6/2015 | Grandfield | H01Q 3/28 342/368 |
| 2016/0268681 | A1* | 9/2016 | Hoole | H01Q 3/2611 |
| 2018/0277939 | A1* | 9/2018 | Peitzer | H01Q 21/28 |
| 2019/0058262 | A1* | 2/2019 | Maruyama | G01S 7/2813 |
| 2020/0014117 | A1* | 1/2020 | Wium | H01Q 1/38 |

FOREIGN PATENT DOCUMENTS

| | | | |
|---|---|---|---|
| EP | 1 494 313 | A1 | 1/2005 |
| EP | 3 098 903 | A1 | 11/2016 |

OTHER PUBLICATIONS

English language translation of CN patent publication 102498615 A, dated Jun. 13, 2012.

* cited by examiner

SYSTEMS AND METHODS FOR REDUCING SIGNAL RADIATION IN AN UNWANTED DIRECTION

FIELD

The present invention relates generally to radio frequency communication hardware. More particularly, the present invention relates to systems and methods for reducing signal radiation in an unwanted direction while simultaneously preserving signal radiation outside of the unwanted direction.

BACKGROUND

Technical advantages and regulatory compliance rules make it desirable to limit the amount of signal radiation that extends in a particular direction from an antenna system. For example, in some scenarios, the signal radiation in a particular direction must be controlled to meet regulatory requirements or to mitigate interference with other systems. Indeed, the Federal Communications Commission (FCC) limits the effective isotropic radiated power (EIRP) radiated in a conical region of +/−60° around the zenith (i.e. a skyward direction) to 21 dbm for a WiFi antenna operating in the 5 GHz U-NII 1 band, meaning that, for a radio with a maximum output power of 0.5 W (27 dBm), the maximum antenna gain in the skyward direction is less than −6 dBi. However, antenna gain outside of such the skyward direction, that is, in a primary region of interest, must be maintained with a specific gain requirement for a good RF communication signal. Indeed, the WiFi antenna operating in the 5 GHz band may have a peak gain requirement of 6 dBi for a good communication link. Accordingly, there are conflicting requirements, and such conflicting requirements are poorly addressed by known systems and methods. For example, known systems and methods to limit the amount of signal radiation in a particular direction include reducing the antenna system's overall gain, modifying the antenna system's radiation pattern, and modifying the antenna system's antenna beam width. However, each of these systems and methods includes disadvantages.

For example, systems and methods that reduce the overall gain of the antenna system detune the antenna system, add an attenuator, or reduce output power of a power amplifier. However, such adjustments lower the signal strength from the antenna system in all directions rather than in just an unwanted direction and, in addition to reducing the signal strength of a signal transmitted by the antenna system, may even reduce the signal strength of a signal the antenna system can receive. Furthermore, systems and methods that modify the antenna system's radiation pattern do so by adding a mechanical or electrical beam tilt to shift a main lobe of radiation away from the unwanted direction where low levels of signal radiation are desired. However, when the antenna system includes the mechanical down tilt, the antenna system must be mounted on a fixed or adjustable platform that is tilted so that a main antenna beam points away from the unwanted direction, thereby adding large and potentially complex mechanical structures to implement, which are dependent on an operator for correct installation. When the antenna system includes the electrical down tilt, a progressive phase shift is implemented to individual antenna elements of an antenna array, shifting a main lobe of radiation away from the unwanted direction, but limiting range because, at larger phase shifts, side lobes start to emerge and increase the signal radiation emitted in the unwanted direction. Further still, systems and methods that modify the antenna system's beam width do so by adding additional antenna elements to the antenna system, such as reflectors or directors, or increase a number of the antenna elements in the antenna array. However, these additional elements require additional volume and may increase peak gain, thereby exceeding FCC limits.

In view of the above, there is a continuing, ongoing need for systems and methods that can reduce radiation in an unwanted direction while simultaneously preserving signal radiation outside of the unwanted direction.

DETAILED DESCRIPTION

Figure 1:
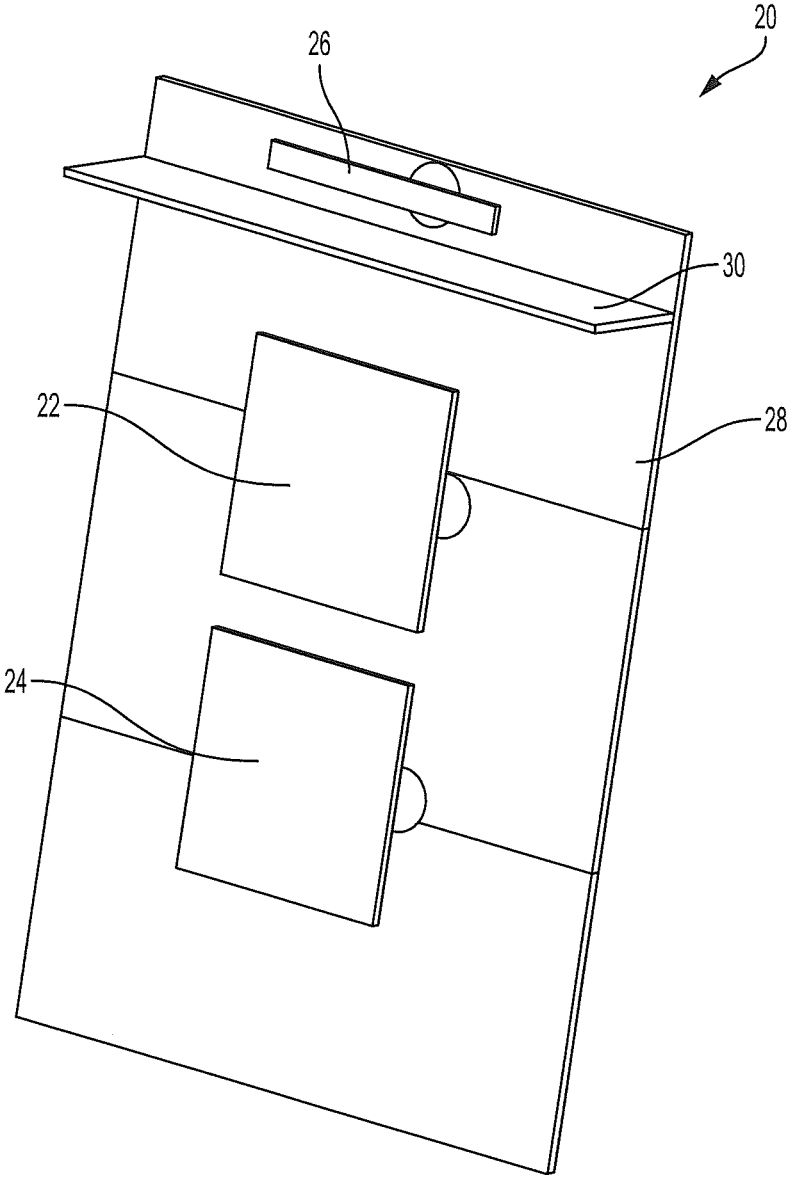
FIG. 1 is a perspective view of an antenna system in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include an antenna system that can reduce signal radiation in an unwanted direction, for example, a skyward direction, while simultaneously preserving signal radiation outside of the unwanted direction. The antenna system can include a signal input source, a main antenna electrically coupled to the signal input source, and a secondary antenna electrically coupled to the signal input source. In some embodiments, the main antenna can include an array of antennas, in some embodiments, the main antenna can have various geometries, including a dipole, a monopole, and a helix, among others, and in some embodiments, the main antenna can be dual polarized. In some embodiments, the secondary antenna can include a small (volume and footprint) patch antenna relative to the main antenna, in some embodiments, the secondary antenna can be the same type as the main antenna, in some embodiments, the secondary antenna can have a smaller frequency bandwidth than the main antenna, and in some embodiments, the secondary antenna can have a single polarization or be dual polarized.

The main antenna can transmit a primary signal producing a primary radiation pattern in response to energy from the signal input source, and the secondary antenna can transmit a secondary signal producing a secondary radiation pattern in response to the energy from the signal source. The secondary signal can be amplitude modified and phase shifted to position the secondary radiation pattern to cancel out or reduce a portion of the primary radiation pattern extending in the unwanted direction while substantially preserving portions of the primary radiation pattern extending outside of the unwanted direction. For example, a first maximum point (peak gain) of the primary radiation pattern that extends in the unwanted direction can be identified, and a physical position of and electrical input into the secondary antenna can be adjusted so that a second maximum point (peak gain) of the secondary radiation pattern extends in the unwanted direction at an angle that aligns with the first maximum point of the primary radiation pattern. That is, an amplitude (gain) and phase shift of the secondary signal can cancel out or reduce the peak gain of the primary radiation pattern in the unwanted direction, but can simultaneously preserve portions of the primary radiation pattern outside of the unwanted direction.

In some embodiments, a ground plane can be coupled to both the main antenna and the secondary antenna, and the ground plan can be continuous or discontinuous between the main antenna and the secondary antenna. In some embodiments, the ground plane may include various reflectors, such as corner reflectors, and the reflectors may be associated with one or both of the main antenna and the secondary antenna for use in positioning the primary radiation pattern and the secondary radiation pattern. In some embodiments, the ground plane can include a reflector portion separating the main antenna and the secondary antenna to assist in positioning the secondary radiation pattern.

FIG. 1 is a perspective view of an antenna system 20 in accordance with disclosed embodiments. As seen in FIG. 1, the antenna system 20 can include a first main antenna 22, a second main antenna 24, and a secondary antenna 26 coupled to, for example, a continuous ground plane 28. The continuous ground plane 28 may include a reflector portion 30 separating the first main antenna 22 and the second main antenna 24 from the secondary antenna 26.

Figure 2:
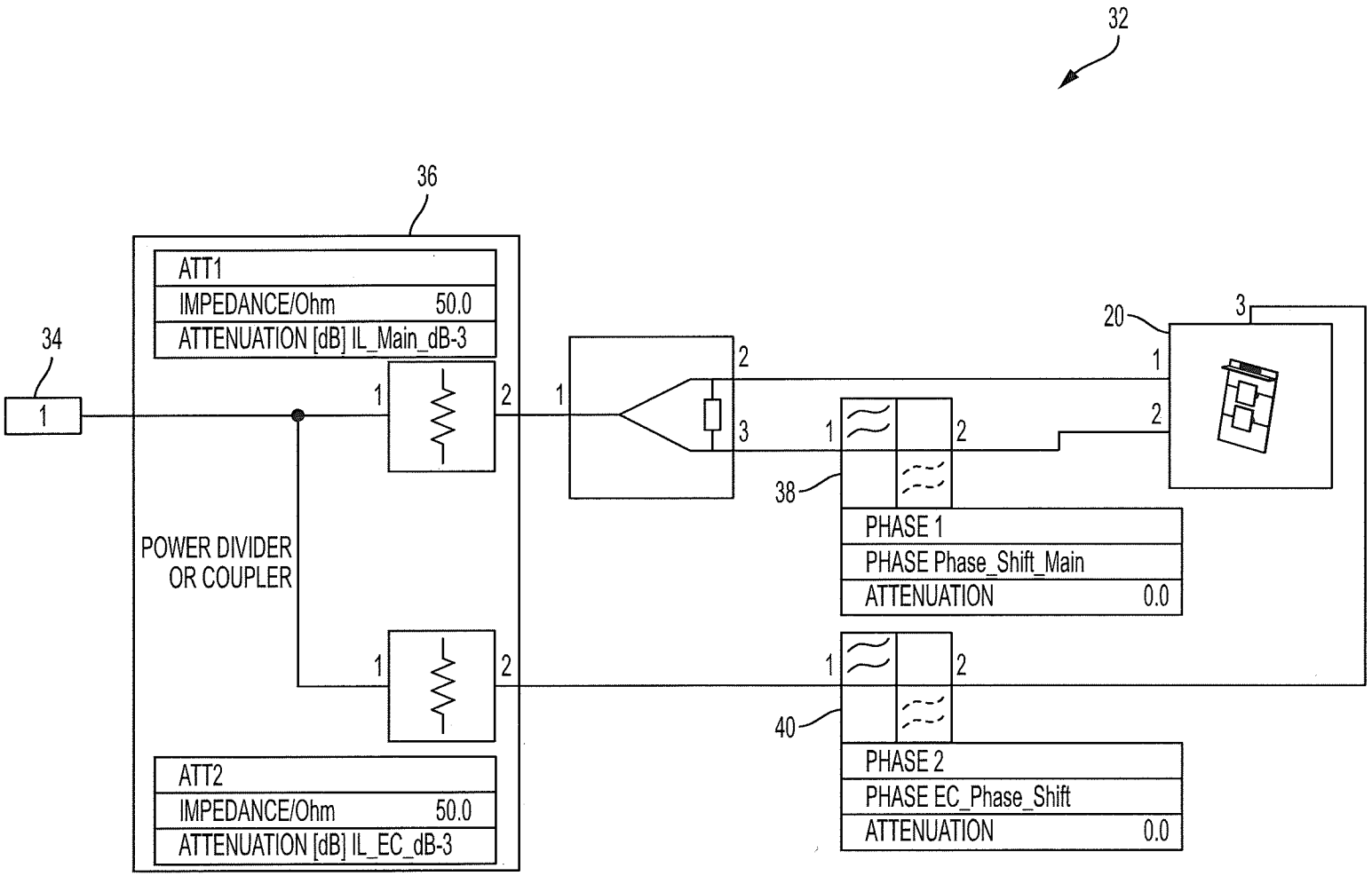
FIG. 2 is a block diagram of an antenna system and an antenna feed network in accordance with disclosed embodiments.

FIG. 2 is a block diagram of the antenna system 20 and an antenna feed network 32 in accordance with disclosed embodiments. As seen in FIG. 2, the antenna system 20 can be fed by an electrical signal input source 34, for example, a radio, in combination with a power divider or coupler 36, a main phase shifter 38, and a secondary phase shifter 40. In operation, the power divider or coupler 36 can split electrical energy transmitted by the electrical signal input source 34 into a main branch serving the first main antenna 22 and the second main antenna 24 and a secondary branch serving the secondary antenna 26. In some embodiments, the power divider or coupler 36 can divide the electrical energy transmitted by the electrical signal input source 34 unequally between the main branch and the secondary branch such that a secondary signal feeding the secondary antenna 26 has a lower amplitude and gain than a primary signal feeding the first main antenna 22 and the second main antenna 24. The main branch can further split the primary signal between the first main antenna 22 and the second main antenna 24, and the portion of the primary signal directed towards the second main antenna 24 can be fed through the primary phase shifter 38 to induce portions of a main lobe of a primary radiation pattern formed collectively by the first main antenna 22 and the second main antenna 24 to tilt away from an unwanted direction. The secondary signal directed towards the secondary antenna 26 can be fed through the secondary phase shifter 40 to cancel out or reduce a portion of the primary radiation pattern extending in the unwanted direction while substantially preserving portions of the primary radiation pattern outside of the unwanted direction.

Although the antenna system 20 and the feed network 32 shown in FIG. 1 and FIG. 2 are shown with the first main antenna 22, the second main antenna 24, the power divider or coupler 36, and the main phase shifter 38, embodiments disclosed herein are not so limited. For example, in some embodiments, the antenna system 20 can include the first main antenna 22 without the second main antenna 22. Accordingly, the feed network 32 need not include the power divider or coupler 36 and the main phase shifter 38. Furthermore, in some embodiments, the antenna system 20 can include a plurality of main antennas in addition to the first main antenna 22 and the second main antenna 24. Accordingly, the feed network 32 can include additional branches for the power divider or coupler 36 and a plurality of phase shifters in addition to the phase shifter 38.

Figure 3:
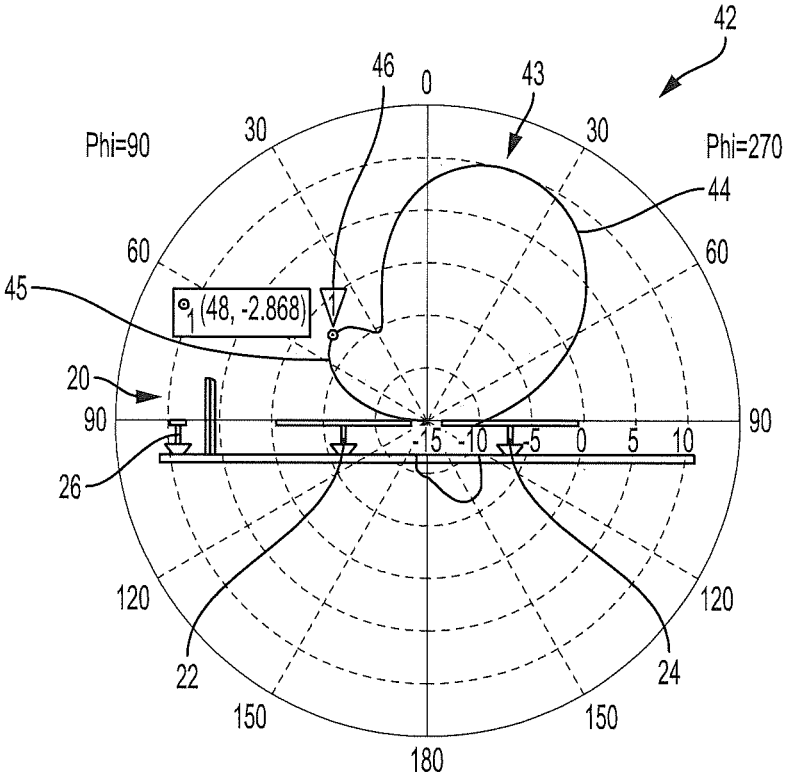
FIG. 3 is a graph of a primary radiation pattern in the elevation plane for an antenna system in accordance with disclosed embodiments.

FIG. 3 is a graph 42 of the primary radiation pattern 43 in the elevation plane for the antenna system 20 in accordance with disclosed embodiments. For example, the primary radiation pattern 43 can be produced by the first main antenna 22 and the second main antenna 24 being fed with the primary signal. The primary radiation pattern 43 may include a main lobe 44 tilted away from the unwanted direction, for example, a skyward direction, and a secondary lobe 45 radiating power in the unwanted direction. In the graph 42 shown in FIG. 2, the zenith is at an angle of 90°, and the skyward direction is from 30° to 150°.

Figure 4:
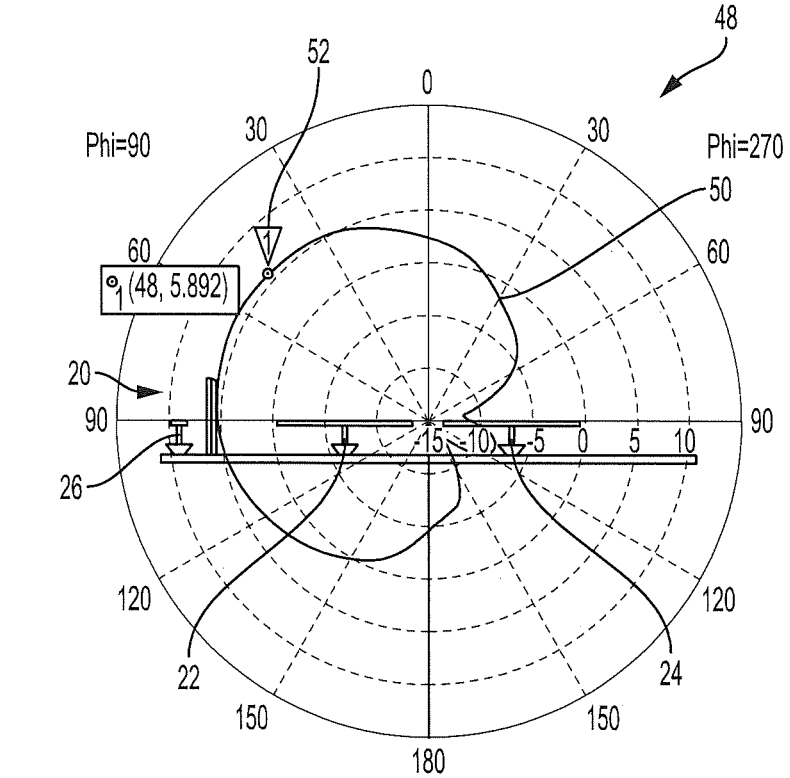
FIG. 4 is a graph of a secondary radiation pattern in the elevation plane for an antenna system in accordance with disclosed embodiments.

A maximum point (peak value) 46 of the secondary lobe 45 in the unwanted direction can be identified and used to position and otherwise tune a secondary radiation pattern produced by the secondary antenna 26 fed with the secondary signal. For example, FIG. 4 is a graph 48 of the secondary radiation pattern 50 in the elevation plane for the antenna system 20 and includes a maximum point (peak value) 52 that is phase shifted and aligned with the maximum point 46 to reduce or cancel out a portion of the primary radiation pattern in the unwanted direction, including the peak value 46 thereof. In some embodiments, an amplitude (gain) of the secondary signal producing the secondary radiation pattern 50 may be identified based on a ratio of a first gain of the primary radiation pattern 43 in the unwanted direction to a second gain of the secondary radiation pattern 50 in the unwanted direction. In some embodiments, an amount of a phase shift of the secondary signal can be equal to a phase difference between the first gain of the primary radiation pattern 43 in the unwanted direction and the second gain of the secondary radiation pattern 50 in the unwanted direction.

Figure 5:
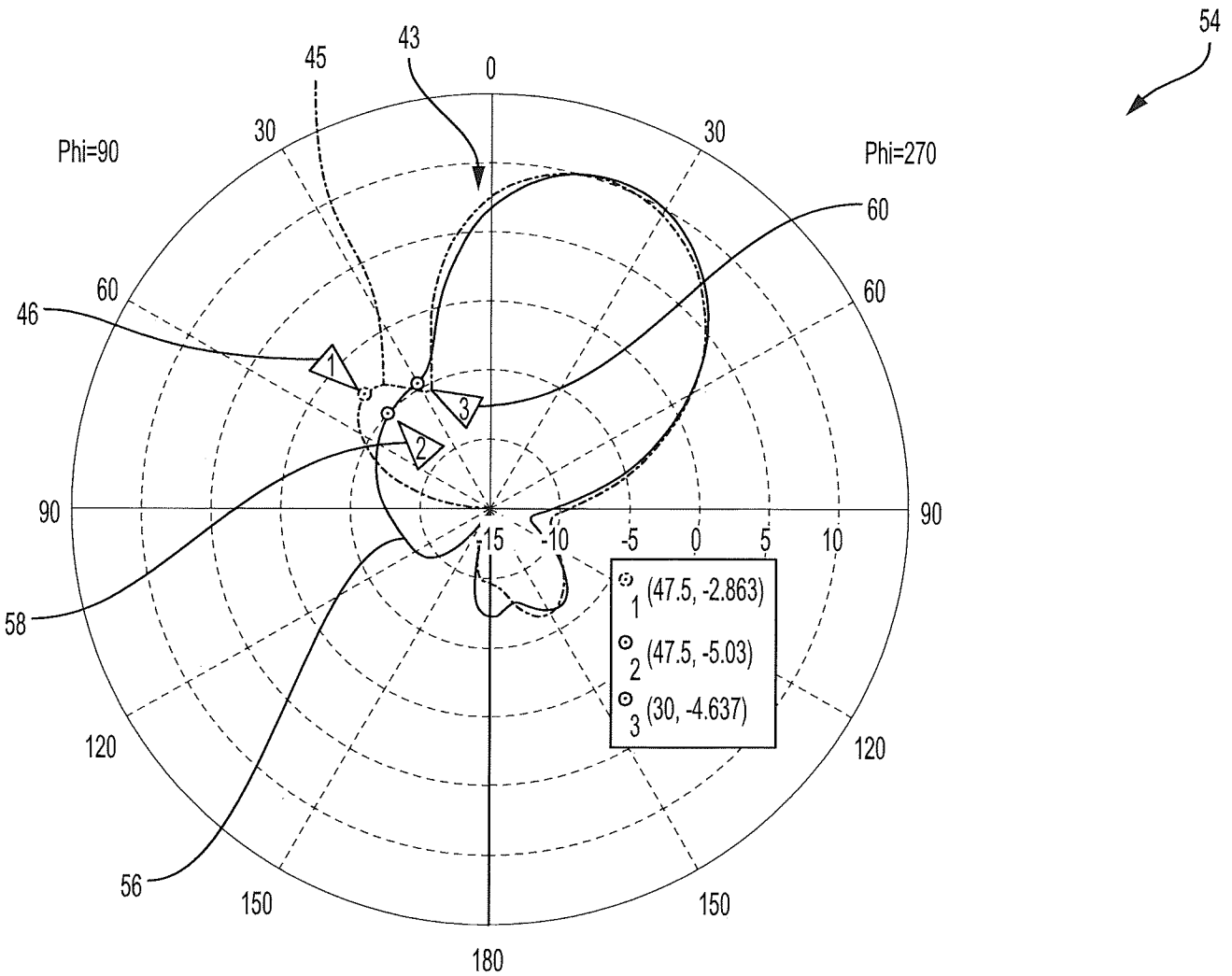
FIG. 5 is a graph of a primary radiation pattern and a total combined radiation pattern in the elevation plane for an antenna system in accordance with disclosed embodiments.

FIG. 5 is a graph 54 of the primary radiation pattern 43 and a total combined radiation pattern 56 in the elevation plane for the antenna system 20 in accordance with disclosed embodiments. As seen in FIG. 5, by combining the secondary radiation pattern 50 with the primary radiation pattern 43, the maximum point 46 of the primary radiation pattern 43 can be reduced in the unwanted direction to the maximum point 58 of the total combined radiation pattern 56 in the unwanted direction while the total combined radiation pattern 56 outside of the unwanted direction can be substantially equal to the primary radiation pattern 43 outside of the unwanted direction, meaning that the primary radiation pattern 43 outside of the unwanted direction can be substantially unchanged by combining the secondary radiation pattern 50 with the primary radiation pattern 43. Although, as seen with point 60, the total combined radiation pattern 56 may increase relative to the primary radiation pattern 43 at some points, systems and methods disclosed herein still reduce the maximum point 46 of the primary radiation pattern 43 in the unwanted direction to provide for improved functionality and compliance with regulatory requirements.

Systems and methods disclosed herein have been described in connection with the antenna system reducing signal radiation in an unwanted direction to comply with regulatory requirements while simultaneously preserving signal radiation produced outside of the unwanted direction. However, it is to be understood that applications of systems and methods disclosed herein are not so limited. Instead, systems and methods disclosed herein can be used to reduce signal radiation in any direction and for any reason as would be known and desired by one of ordinary skill in the art. For example, systems and methods disclosed herein can be used to mitigate interference with other devices, such as adjacent access points or base stations, by reducing signal radiation in a direction towards such devices while simultaneously preserving signal radiation produced outside of such a direction.

Although a few embodiments have been described in detail above, other modifications are possible. For example, other components may be added to or removed from the described systems, and other embodiments may be within the scope of the invention.

From the foregoing, it will be observed that numerous variations and modifications may be effected without departing from the spirit and scope of the invention. It is to be understood that no limitation with respect to the specific system, method, or application described herein is intended or should be inferred. It is, of course, intended to cover all such modifications as fall within the spirit and scope of the invention.

What is claimed is:

1. An antenna system comprising:

a signal input source;

a main antenna electrically coupled to the signal input source; and a secondary antenna electrically coupled to the signal input source, wherein the secondary antenna is smaller in volume, footprint, or frequency bandwidth relative to the main antenna, wherein the main antenna transmits a primary signal to produce a primary radiation pattern in response to a first portion of energy from the signal input source, wherein the secondary antenna transmits a secondary signal to produce a secondary radiation pattern in response to a second portion of the energy from the signal input source, and wherein the secondary signal is amplitude modified and phase shifted to position the secondary radiation pattern to cancel out or reduce a first portion of the primary radiation pattern extending in an unwanted direction while substantially preserving a second portion of the primary radiation pattern outside of the unwanted direction.

2. The antenna system of claim 1 further comprising a continuous ground plane coupled to both the main antenna and the secondary antenna.

3. The antenna system of claim 2 wherein the ground plane includes a reflector portion separating the main antenna and the secondary antenna to assist in positioning the secondary radiation pattern.

4. The antenna system of claim 1 wherein the first portion of the primary radiation pattern includes a maximum point of the primary radiation pattern in the unwanted direction.

5. The antenna system of claim 1 wherein an amplitude of the secondary signal is based on a ratio of a first gain of the primary signal in the unwanted direction to a second gain of the secondary signal in the unwanted direction.

6. The antenna system of claim 1 wherein an amount of a phase shift of the secondary signal is equal to a difference between a first gain of the primary signal in the unwanted direction and a second gain of the secondary signal in the unwanted direction.

7. The antenna system of claim 1 wherein a power divider divides the energy from the signal input source between the main antenna and the secondary antenna.

8. The antenna system of claim 7 wherein the power divider unequally divides the energy from the signal input source between the main antenna and the secondary antenna such that the secondary signal has a lower amplitude than the primary signal.

9. The antenna system of claim 1 wherein the main antenna includes an array of antennas.

10. The antenna system of claim 1 wherein the unwanted direction is skyward.

11. A method comprising:

identifying a first maximum point of a primary radiation pattern extending in an unwanted direction, the primary radiation pattern produced by a main antenna transmitting a primary signal;

positioning a second maximum point of a secondary radiation pattern to extend in the unwanted direction and align with the first maximum point of the primary radiation pattern extending in the unwanted direction, the secondary radiation pattern produced by a secondary antenna transmitting a secondary signal, and the secondary antenna being smaller in volume, footprint, or frequency bandwidth relative to the main antenna; and amplitude modifying and phase shifting the secondary signal to cancel out or reduce the first maximum point of the primary radiation pattern extending in the unwanted direction while substantially preserving portions of the primary radiation pattern outside of the unwanted direction.

12. The method of claim 11 further comprising coupling the main antenna and the secondary antenna to a continuous ground plane.

13. The method of claim 12 further comprising a reflector portion of the continuous ground plane separating the main antenna and the secondary antenna to assist in positioning the second maximum point of the secondary radiation pattern.

14. The method of claim 11 further comprising setting an amplitude of the secondary signal based on a ratio of a first vain of the primary signal in the unwanted direction to a second gain of the secondary signal in the unwanted direction.

15. The method of claim 11 wherein an amount of the phase shifting of the secondary signal is equal to a difference between a first gain of the primary signal in the unwanted direction and a second gain of the secondary signal in the unwanted direction.

16. The method of claim 11 further comprising a power divider dividing energy from a signal source between the main antenna and the secondary antenna.

17. The method of claim 16 further comprising the power divider unequally dividing the energy from the signal source between the main antenna and the secondary antenna such that the secondary signal has a lower amplitude than the primary signal.

18. The method of claim 11 wherein the main antenna includes an array of antennas.

19. The method of claim 11 wherein the unwanted direction is skyward.

20. An antenna system comprising:

a signal input source;

a continuous ground plane;

a main antenna array coupled to the continuous ground plane and electrically coupled to the signal input source; and a secondary antenna coupled to the continuous ground plane and electrically coupled to the signal input source, wherein the secondary antenna is smaller in volume, footprint, or frequency bandwidth relative to the main antenna, wherein the main antenna array transmits a primary signal to produce a primary radiation pattern in response to a first portion of energy from the signal input source, wherein the secondary antenna transmits a secondary signal to produce a secondary radiation pattern in response to a second portion of the energy from the signal input source, wherein the secondary signal is amplitude modified and phase shifted to position the secondary radiation pattern to cancel out or reduce a first portion of the primary radiation pattern extending in an unwanted direction while substantially preserving second portions of the primary radiation pattern outside of the unwanted direction, wherein a phase shift applied to one antenna in the main antenna array induces the second portions of the primary radiation pattern outside of the unwanted direction to tilt away from the unwanted direction, and wherein a reflector portion of the continuous ground plane separates the main antenna array and the secondary antenna to assist in positioning the secondary radiation pattern.

* * * * *